US005564258A

United States Patent [19]

Jones, Sr. et al.

[11] Patent Number: 5,564,258

[45] Date of Patent: Oct. 15, 1996

[54] METHOD AND APPARATUS FOR HOLDING AND WRAPPING STRETCH WRAP PACKAGING MATERIAL

[75] Inventors: Robert D. Jones, Sr.; Patrick R. Lancaster, both of Louisville, Ky.

[73] Assignee: Lanatech, Inc., Louisville, Ky.

[21] Appl. No.: 338,167

[22] Filed: Nov. 10, 1994

[51] Int. Cl.[6] ..... B65B 13/02; B65B 53/00

[52] U.S. Cl. ..... 53/399; 53/441; 53/556; 53/587; 53/588

[58] Field of Search ..... 53/399, 441, 556, 53/587, 588, 389.1, 389.2, 389.3

[56] References Cited

U.S. PATENT DOCUMENTS

| | | | |
|---|---|---|---|
| 4,232,501 | 11/1980 | Stackhouse | 53/399 |
| 4,300,326 | 11/1981 | Stackhouse | 53/211 |
| 4,317,322 | 3/1982 | Lancaster et al. | 53/399 |
| 4,628,671 | 12/1986 | Storm et al. | 53/588 |
| 4,716,709 | 1/1988 | Lamb et al. | 53/389.2 |
| 4,761,934 | 8/1988 | Lancaster | 53/441 X |
| 4,993,209 | 2/1991 | Haloila | 53/441 X |
| 5,009,055 | 4/1991 | Simmons | 53/580 X |
| 5,161,349 | 11/1992 | Lancaster et al. | 53/441 X |
| 5,182,894 | 2/1993 | Bate | 53/441 X |
| 5,404,691 | 4/1995 | Scherer | 53/441 X |

FOREIGN PATENT DOCUMENTS

| | | |
|---|---|---|
| 0022135 | 1/1981 | European Pat. Off. . |
| 3820048 | 12/1989 | Germany . |
| 4100614 | 7/1992 | Germany . |
| 4236760 | 5/1994 | Germany . |

*Primary Examiner*—Linda Johnson

*Attorney, Agent, or Firm*—Finnegan, Henderson, Farabow, Garrett & Dunner

[57] ABSTRACT

A load is stretch wrapped with a sheet of stretch wrap packaging material by adhering a leading end portion of the sheet to a holding member, dispensing the sheet from a stretch wrap dispenser, and providing relative rotation between the dispenser and the load to wrap the sheet of stretch wrap packaging material on a load. The leading end portion of the sheet is released from the holding member, and a trailing end portion of the sheet is adhered to the holding member. The packaging material between the load and the holding member is severed while being held by the holding member. The sheet of stretch wrap packaging material is held in place against the holding member with a vacuum or by a tacky surface. The severing is accomplished by a hot wire on the holding member.

43 Claims, 6 Drawing Sheets

METHOD AND APPARATUS FOR HOLDING AND WRAPPING STRETCH WRAP PACKAGING MATERIAL

BACKGROUND OF THE INVENTION

The present inventions relates to a method and apparatus for holding and wrapping stretch wrap packaging material.

When stretch wrapping loads with a sheet of stretch wrap packaging material, relative rotation is provided between a film web dispenser and a load. This is generally accomplished by one of two methods. Either the dispenser is rotated around a stationary load, or the load is rotated on a turntable next to a stationary dispenser. Over time, stretch wrapping technology has become increasingly automated, and clamping arrangements have developed that accommodated and complemented other features of the stretch wrapping operation, to hold and release the stretch wrap packaging material during different phases of the operation. Examples of such clamping arrangements for stretch wrapping machines are shown in U.S. Pat. Nos. 4,232,501 and 4,300,326 to Stackhouse and 4,317,322 to Lancaster et al., which are incorporated herein by reference.

More lately, a parallel belted clamp, shown in U.S. Pat. No. 4,761,934 to Lancaster, which is incorporated herein by reference, was designed to, provide a clamping arrangement that had less restrictive limitations in positioning and control during stretch wrapping operations, that minimized lateral movement of the clamp during operation and the space required for such movement, that easily oriented itself to the work piece which is clamped, and that is easily positioned and removed from a work location without interfering with other operations of the apparatus.

While commercially successful, this parallel belted clamp has a complex design with a variety of components which presents a potential for misalignment,, wear, and jamming.

The present invention provides an arrangement that allows stretch film to be held and wrapped while providing less concern about alignment, wear, and jamming, and that provides simple low-cost construction and easy operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

In accordance with the purposes of the invention embodied and broadly described, a method and apparatus is provided for stretch wrapping a load with a sheet of stretch wrap packaging material. A leading end of a sheet of stretch wrap packing material is adhered to a holding member. The sheet of packaging material is dispensed from a stretch wrap dispenser and relative rotation is provided between the dispenser and the load to wrap packaging material on the load. The leading end portion of the packaging material is released from the holding member. A trailing end portion of the packaging material is subsequently adhered to the holding member, and the packaging material is severed between the load and the holding member while the holding member continues to hold the packaging material. It is preferable that the method and apparatus of adhering the sheet of packaging material to the holding member includes holding the sheet of packaging material in place against the holding member with a vacuum.

BRIEF DESCRIPTION OF THE DRAWINGS

The accompanying drawings which are incorporated in and constitute a part of the specification, illustrate the present preferred embodiments of the invention and, together with the general description given above and the detailed description of the preferred embodiments given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, a method and apparatus is provided for stretch wrapping a load with a sheet of stretch wrap packaging material. The apparatus includes a holding member, that, as embodied in FIGS. 1*a* and 1*b*, includes a longitudinally extending slender holding member 20 constructed from a circular tube or rod, preferably including a slender channel 40 divided into a series of apertures 42. The holding member may have other constructions such as those shown in FIGS. 3*a* through 3*d* and may be constructed from various materials and in various shapes depending on the particular stretch wrapping application involved. The holding member 20 holds a single side of the stretch wrap packaging material 30 rather than clamping or trapping the stretch wrap packaging material 30 between opposing surfaces as in earlier devices. As such, the packaging material 30 is held with an unopposed and an unclamped surface of the holding member 20. In addition, the holding member 20 preferably extends transversely across a substantial portion of the width of the sheet of packaging material 30.

Figure 1A:
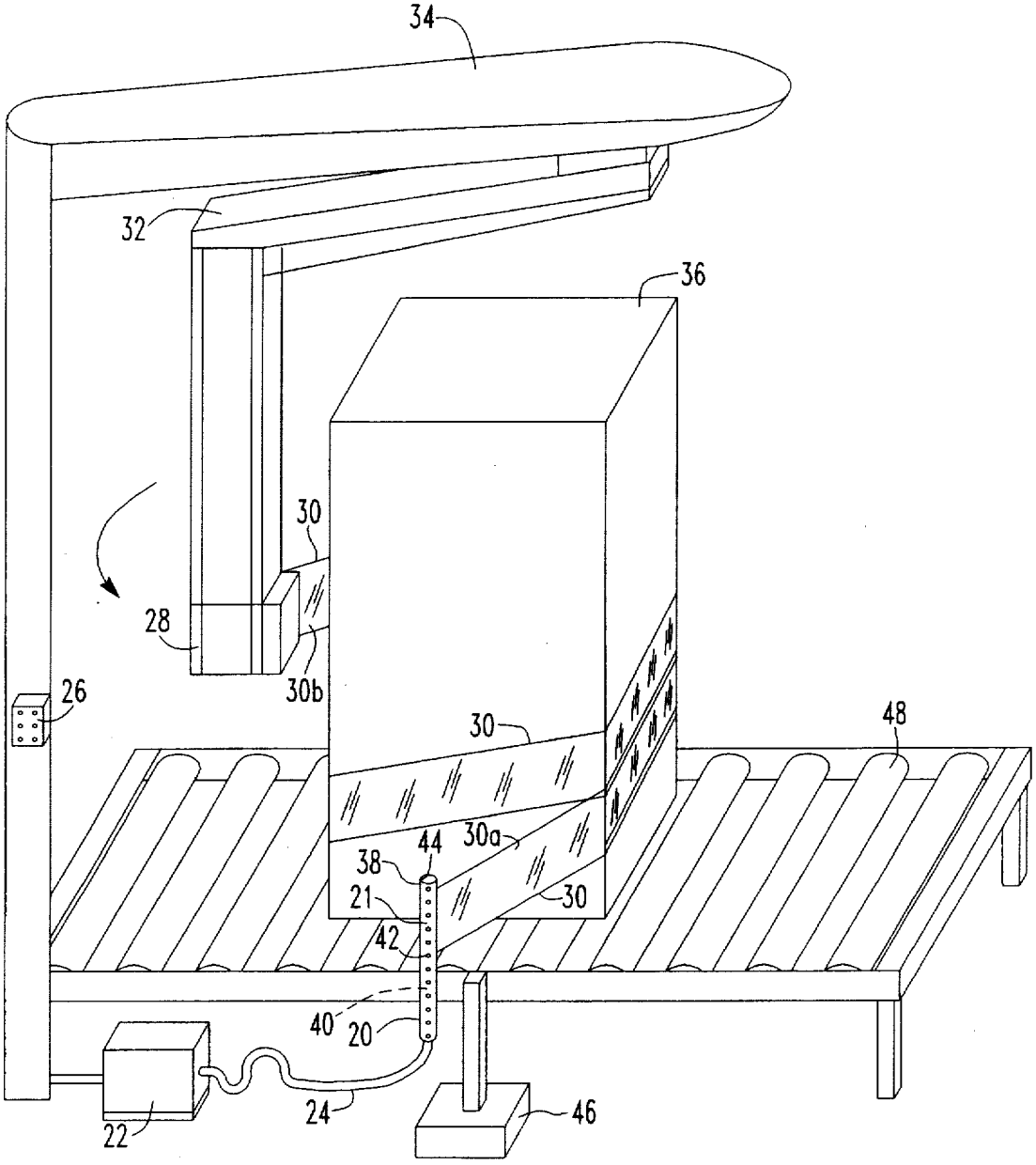
FIGS. 1*a* and 1*b* are sequential perspective views of the stretch wrapping apparatus, at two different points in operation, incorporating the teachings of the present invention.
Figure 1B:
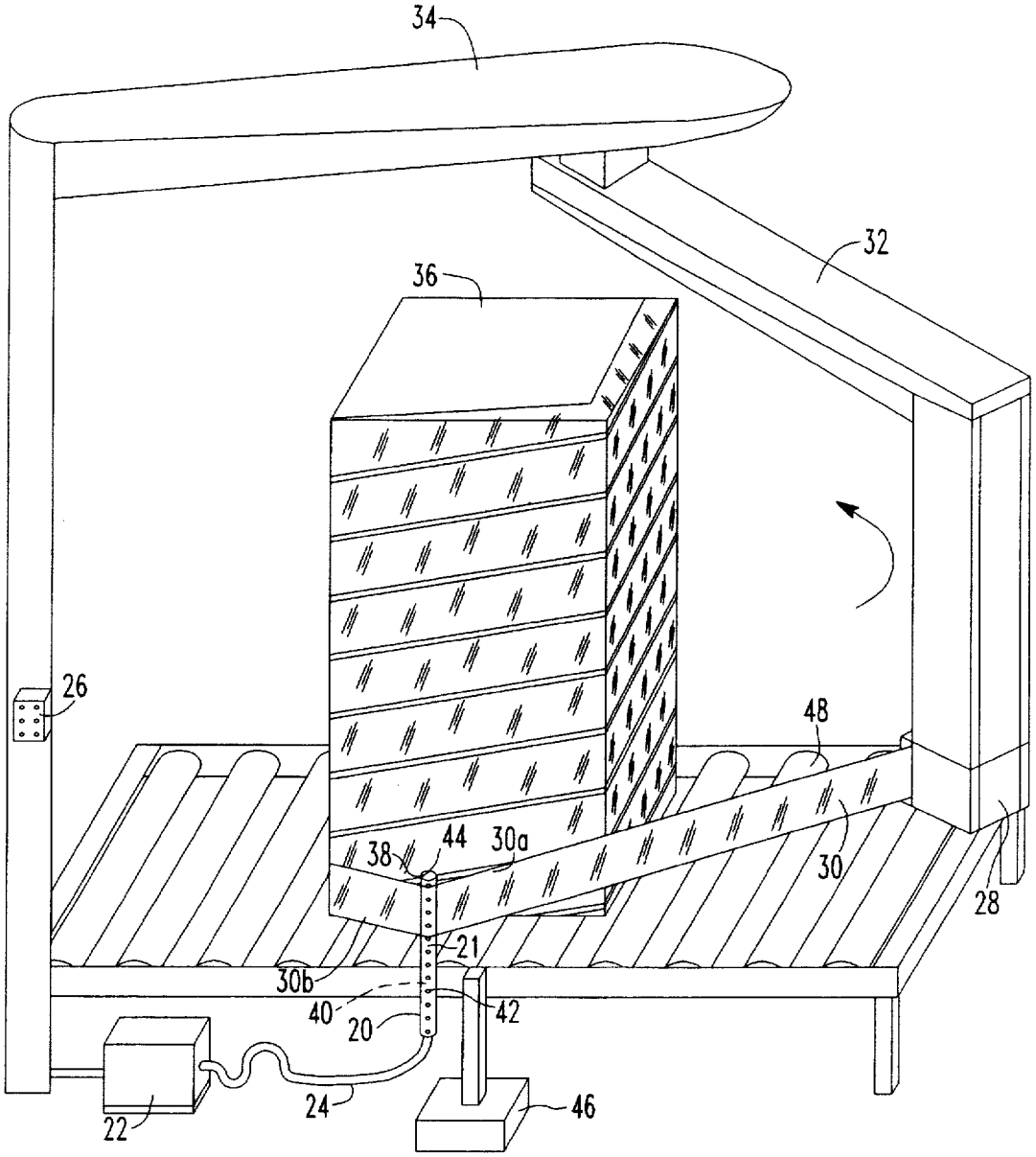

According to the present invention, means are provided for adhering and releasing a sheet of stretch wrap packaging material 30 to the holding member. According to one aspect of the invention, the means for adhering and releasing includes, as shown in FIGS. 1*a* and 1*b*, an automatically controlled compressor and vacuum pump 22, which is connected to holding member 20 by hose 24 for providing a vacuum through apertures 42 to adhere the packaging material 30 to holding member 20, and for stopping the application of a vacuum, or supplying a positive flow of air through apertures 42 to release and blow the packaging material away from the holding member 20. Compressor and vacuum pump 22 is controlled by a controller 26 which includes a microprocessor or other control circuitry which provides timing functions in a manner conventional with stretch wrapping machines.

According to the invention, a stretch wrap dispenser is provided for dispensing a sheet of stretch wrap packaging material. As shown in FIGS. 1*a* and 1*b*, stretch wrap dispenser 28 dispenses a sheet of stretch wrap packaging material 30 in a web form. Stretch wrap dispenser 28 includes amount for a roll of stretch wrap packaging material and may also include rollers or other devices for stretching the stretch wrap packaging material longitudinally and/or transversely, as shown in U.S. Pat. No. 5,161,349.

According to the present invention, means are provided for providing relative rotation between the dispenser and the load to wrap stretch wrap packaging material on the load. As shown in FIGS. 1*a* and 1*b*, the means for providing relative rotation includes an L-shaped arm 32 for supporting dispenser 28 and a motor driven bearing 34 for driving the L-shaped arm 32 and dispenser 28 in a circle around a load 36.

According to the present invention, means are provided for severing the packaging material between the load and the holding member while continuing to hold the stretch wrap packaging material with the holding member. As shown in FIGS. 1*a* and 1*b* , the means for severing includes a hot wire 38 on the holding member which acts to heat and sever the film by heating when pulsed with electricity as directed by controller 26. Hot wire 38 is preferably recessed in a groove 44 running along the longitudinal length of holding member 20. Details of an exemplary groove 44 for the hot wire 38 and the apertures 42 and slender channel can be seen in FIGS. 3*a* through 3*d*. Alternatively, the severing means can include a cutter mounted on or apart from the holding member. The cutter may be fixed to or slidable on holding member.

Figure 2A:
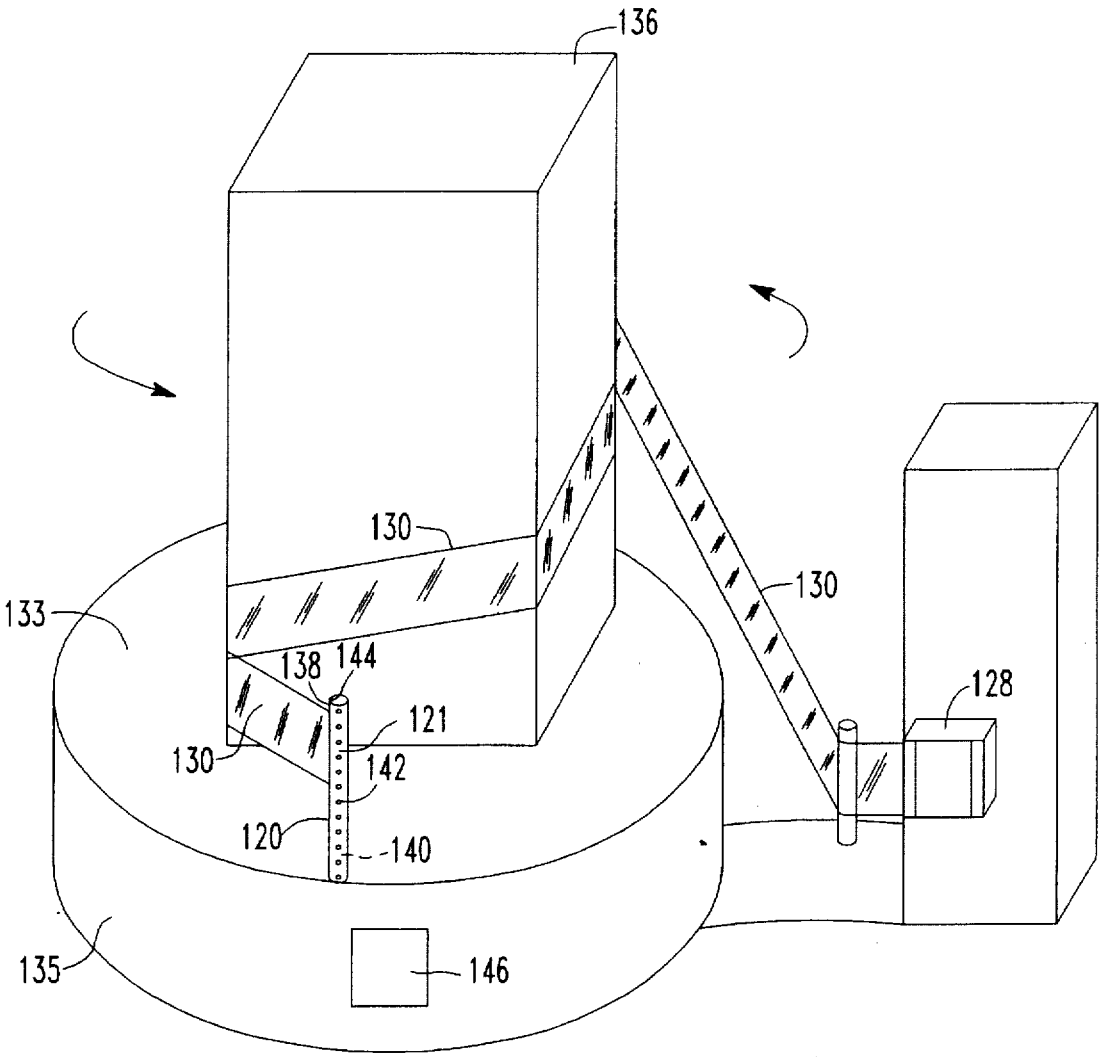
FIGS. 2*a* and 2*b* are sequential perspective views of another stretch wrapping apparatus, at two different points in operation, incorporating the teachings of the present invention.
Figure 2B:
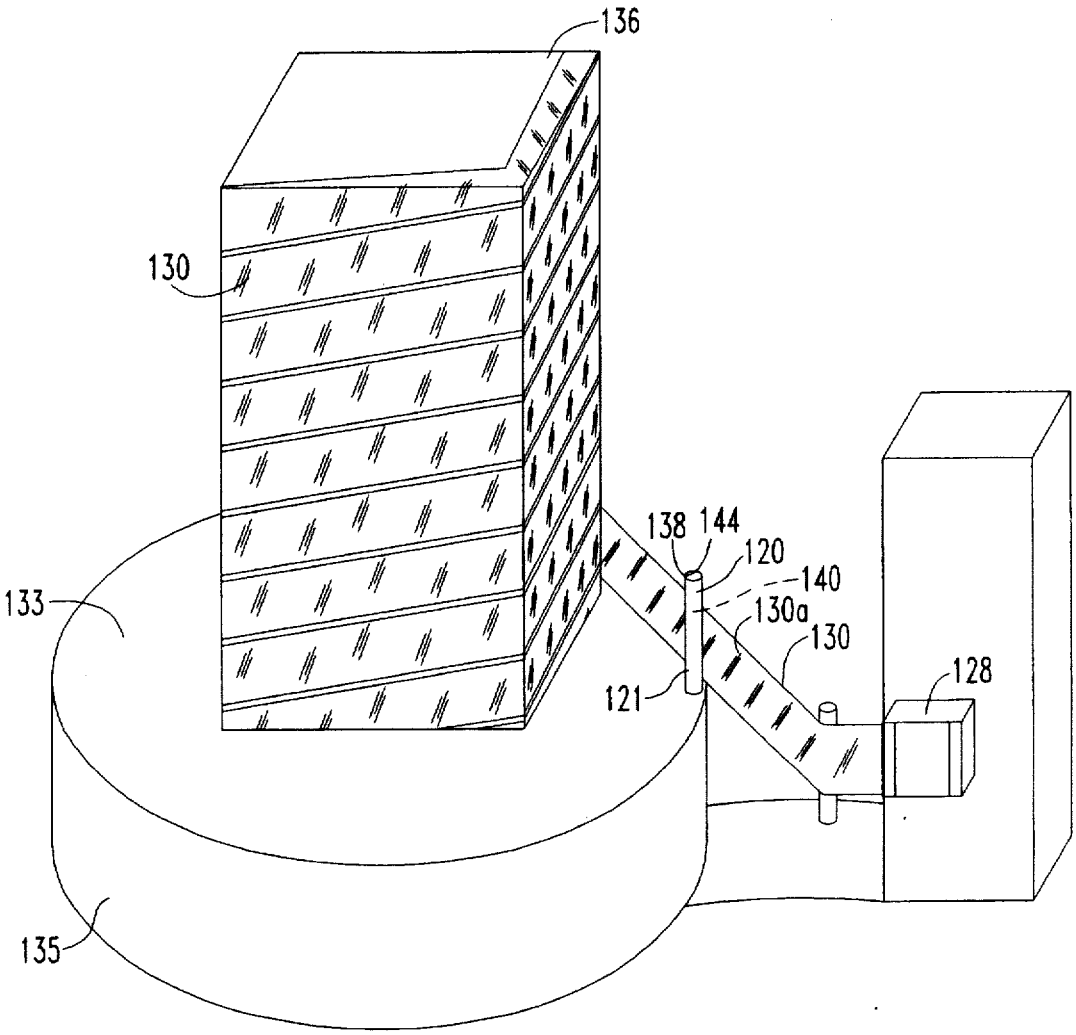
Figure 3A:
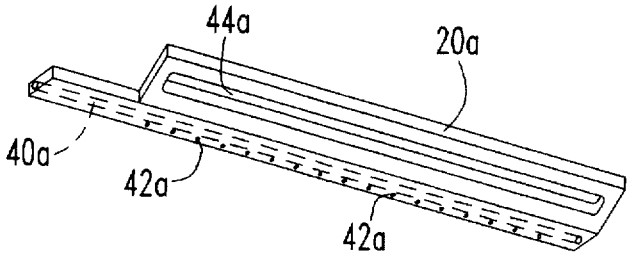
FIGS. 3*a* through 3*d* are perspective views of an alternative embodiment of a component shown in FIGS. 1 and 2.
Figure 3B:
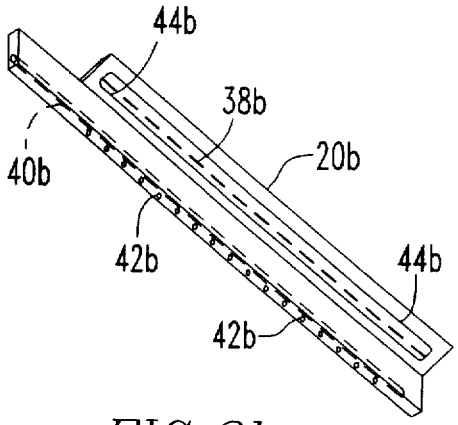
Figure 3C:
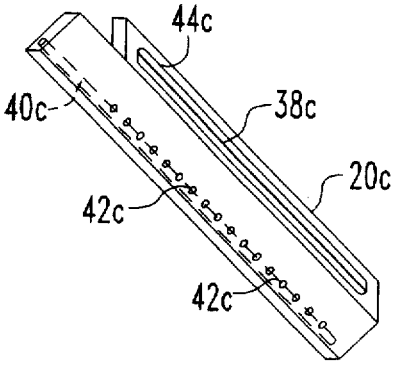
Figure 3D:
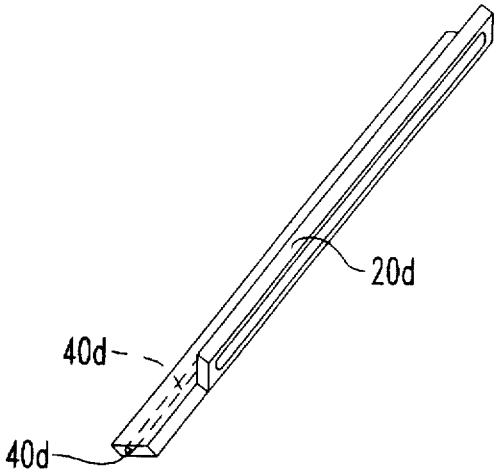

Another embodiment of the present invention is shown in FIGS. 2*a* and 2*b*, in which similar numerals designate similar components. As shown in FIG. 2*a*, the means for providing relative rotation between the dispenser 128 and the load 136 to wrap the stretch wrap packaging material on the load includes a motor driven turntable 133 mounted in base 135. Load 136 is rotated about a generally vertical axis by turntable 133. Holding member 120 may be similar to holding member 20 as described in respect to FIG. 1.

Holding member 120, as well as 20, can include a means for adhering and releasing, which includes an adhesive surface 121 on holding member 120 which adheres stretch wrap packaging material 130 to holding member 120. The adhesive surface may be a tacky surface and include, for example, a cylinder coated with vinyl plastisol which has been formed and machined as described in U.S. Pat. No. 5,186,981, which is incorporated herein by reference. The choice of tackiness will depend on the application. Alternatively, the adhesive surface 121 of holding member 120 may be a prickly or irrgular surface The means for adhering and releasing the stretch wrap packaging material from the holding member 120 may include a motor driven actuator 146 which is connected to holding member 120. The actuator can rotate holding member 120 about its primary vertical longitudinal axis relative to packaging material 130 to alternately engage and release packaging material 130 from holding member 120. Alternately, ! the actuator can slide holding member 120 by translation or pivoting to alternately engage and separate packaging material 130 from holding member 120. The holding member 120 may be extended and retracted with a single motion and in a single linear direction. The surface of turntable 133 is positioned between the wrapping area above the turntable where the holding member 120 is extended and an actuator 146 for the holding member 120.

A method for stretch wrapping a load according to the present invention is shown in FIG. 1*a*. As shown, a load is conveyed by conveyor 48 to a wrapping station. The surface of conveyor 48 is positioned between the wrapping area above the conveyor where the holding member 20 is extended and an actuator 46 for the holding member 20. A leading end portion 30*a* of a sheet of stretch wrap packaging material is adhered to holding member 20 by energizing vacuum pump 22 when stretch wrap packaging material 30 is proximate holding member 20. Alternatively, or in combination with this method of adhering, the stretch wrap packaging material may adhered to holding member 20 by use of a tacky surface 21 on holding member 20.

The sheet of stretch wrap packaging material 30 is dispensed from the stretch wrap dispenser 28 while providing relative rotation between the dispenser 28 and the load 36 throughout the stretch wrap packaging material on the load. As shown in FIG. 1*a*, the relative rotation is accomplished by moving dispenser 28 around load 36.

After the stretch wrap packaging material 30 is wrapped around the load so that it is secured to the load, for example, by overwrapping, leading end portion 30*a* of the stretch wrap packaging material 30 is released from the holding member 20 by one or more of methods such as the following: stopping the vacuum through apertures 42 by stopping the vacuum from vacuum pump 22, blowing the stretch wrap packaging material away from the holding member such as by reversing the vacuum and forcing pressurized air from the compressor and vacuum pump 22 through hose 24 and out apertures 42, or by rotating or sliding holding member 20 relative to stretch wrap packaging material 30 by using motor-driven actuator 46. The relative rotation continues until load 36 is completely wrapped to the requirements of the application. At this time, a trailing end portion 30*b* of the stretch wrap packaging material is adhered to holding member 20 by actuating the vacuum through apertures 42 and/or contacting a tacky surface 21.

The packaging material between the load 36 and the holding member 20 is severed by pulsing hot wire 38 while continuing to hold stretch wrap packaging material with the holding member so as to be able to again start stretch wrapping the next load with the portion of stretch wrap packaging material extending between the holding member 20 and dispenser 28.

After wrapping, the trailing end of packaging material may be secured to the load and wiped down by conventional wipedown mechanisms or by ionizing the air through the apertures.

All of these functions can be controlled with a typical programmed microprocessor or other controller devices which are conventionally used with the stretch wrapping apparatus.

Figure 4A:
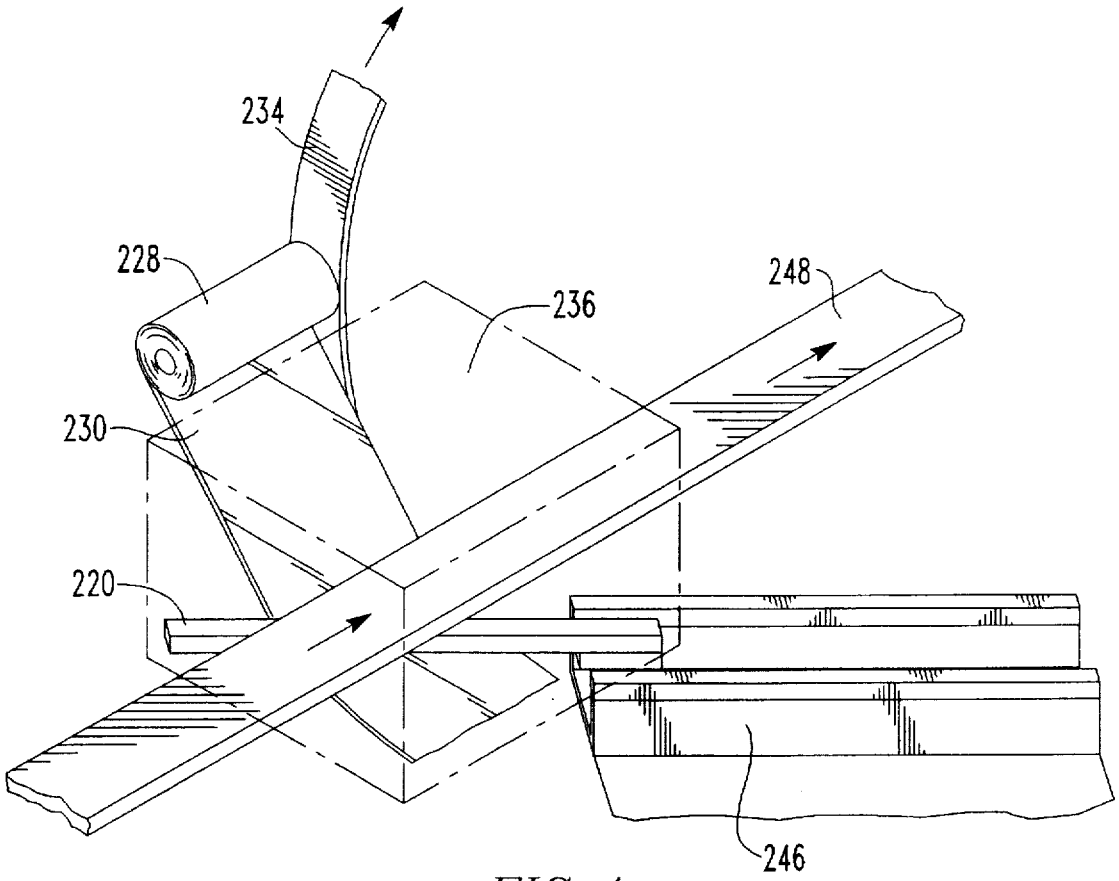
FIG. 4*a* and 4*b* are perspective and end views of yet another stretch wrapping apparatus, at two different points in operation, incorporating the teachings of the present invention.
Figure 4B:
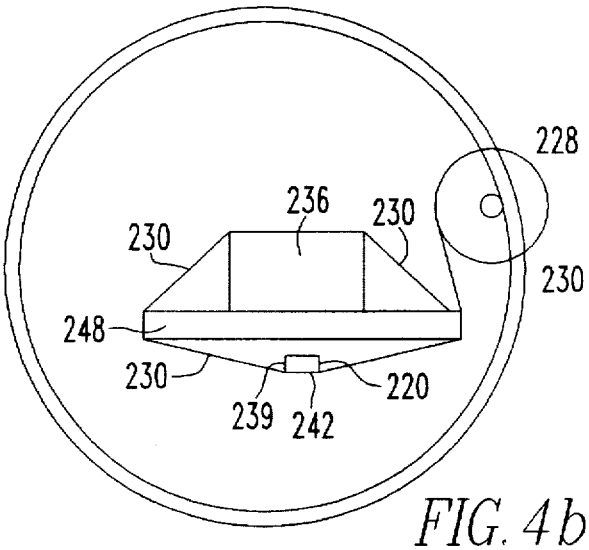

Another embodiment of the present invention is shown in FIGS. 4*a*and 4*b* where the dispenser 228 includes a roll of stretch wrap packaging material 230 mounted on a ring 234 to rotate about a horizontal axis. Load 236 can be manually placed in the wrapping area or conveyed into the wrapping area within ring 234 by conveyor 248, and holding member 220 is linearly extended and retracted into and out of the wrapping area by a motor driven actuator 246 such as a rodless cylinder. A cutter 239 is mounted on holding member 220 and is actuated by rotating holding member 220 so that cutter 239 engages packaging material 230.

Other means for providing relative rotation, for dispensing the packaging material, and for severing thee packaging material may be provided, such as those shown in the patents which are incorporated by reference. Other means for adhering and holding the packaging material may be provided, including electrostatic, frictional and mechanical engagements by a holding member which engages and holds packaging material with an unopposed or unclamped surface, or which engages a single side of the packaging material.

The present invention eliminates the need for trapping the film between multiple arms and the attendant complexity and movement of such devices. The invention furthermore reduces the size, cost, and unreliability of the assembly. It also permits the holding member to be constructed to extend up between the rollers of a roller conveyor and be retracted at will.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. A method for stretch wrapping a load with a sheet of stretch wrap packaging material comprising:

adhering a leading end portion of the sheet of stretch wrap packaging material to a holding member with an adhesive or tacky surface by holding the sheet of stretch warp packaging material in place against the holding member with the adhesive or tacky surface;

dispensing the sheet of stretch wrap packaging material from a stretch wrap dispenser;

providing relative rotation between the dispenser and the load to wrap the stretch wrap packaging material on the load;

releasing the leading end portion of the stretch wrap packaging material from the holding member;

adhering a trailing end portion of the stretch wrap packaging material to the holding member with an adhesive or tacky surface by holding the sheet of stretch wrap packaging material in place against the holding member with the adhesive or tacky surface; and severing the packaging material between the load and the holding member while continuing to hold the stretch wrap packaging material with the holding member.

2. The method of claim 1 wherein the adhering step includes holding the sheet of stretch wrap packaging material in place against the holding member with an adhesive surface.

3. The method of claim 1 wherein the adhering step includes holding the sheet of stretch wrap packaging material in place against the holding member with a tacky surface.

4. The method of claim 1, wherein the severing step includes severing the stretch wrap packaging material with a severing device on the holding member.

5. The method of claim 1, wherein the severing step includes heating the stretch wrap packaging material with a hot wire on the holding member.

6. The method of claim 1, wherein the releasing step includes sliding the holding member relative to the stretch wrap packaging material.

7. The method of claim 1, wherein the releasing step includes rotating the holding member relative to the stretch wrap packaging material.

8. The method of claim 1, wherein the holding step includes holding the packaging material with an unopposed surface of the holding member.

9. The method of claim 1, wherein the holding step includes holding the packaging material with an unclamped surface of the holding member.

10. The method of claim 1, wherein the holding step includes holding a single side of the stretch wrap packaging material with the holding member.

11. A method for stretch wrapping a load with a sheet of stretch wrap packaging material in a wrapping area and selectively holding the sheet of stretch wrap packaging material with a holding member at a holding location in the wrapping area comprising:

extending the holding member into the wrapping area and relative to a surface between the holding location in the wrapping area and an actuator for moving the holding member;

holding a leading end portion of the sheet of stretch wrap packaging material in place against the holding member with a vacuum;

dispensing the sheet of stretch wrap packaging material from a stretch wrap dispenser;

providing relative rotation between the dispenser and the load to wrap the stretch wrap packaging material on the load;

releasing the leading end portion of the stretch wrap packaging material from the holding member by stopping the vacuum, retracting the holding member out of the wrapping area, and moving the holding member relative to the stretch wrap packaging material and the surface between the holding location in the wrapping area and the actuator;

holding a trailing end portion of the stretch wrap packaging material in place against the holding member with a vacuum; and severing the stretch wrap packaging material between the load and the holding member while continuing to hold the stretch wrap packaging material with the holding member.

12. The method of claim 11, wherein the holding member includes a slender channel and the holding step includes applying a vacuum to the slender channel.

13. The method of claim 11, wherein the holding member includes a slender channel divided into a series of apertures and the holding step includes applying a vacuum to the slender channel and series of apertures.

14. The method of claim 11, wherein the releasing step includes blowing the stretch wrap packaging material away from the holding member.

15. The method of claim 11, wherein the releasing step includes blowing the stretch wrap packaging material away from the holding member by reversing the vacuum.

16. An apparatus for stretch wrapping a load with a sheet of stretch wrap packaging material comprising:

a holding member;

means for adhering and releasing a sheet of stretch wrap packaging material to the holding member including a tacky or adhesive surface on the holding member;

a stretch wrap dispenser for dispensing a sheet of stretch wrap packaging material;

means for providing relative rotation between the dispenser and the load to wrap stretch wrap packaging material on the load; and means for severing the packaging material between the load and the holding member.

17. The apparatus of claim 16 wherein the means for adhering includes a tacky surface on the holding member.

18. The apparatus of claim 16, wherein the means for adhering includes an adhesive surface on the holding member.

19. The apparatus of claim 16, wherein the means for severing includes a severing device on the holding member.

20. The apparatus of claim 16, wherein the means for severing includes a hot wire on the holding member.

21. The apparatus of claim 16, wherein the means for releasing includes means for sliding the holding member relative to the stretch wrap packaging material.

22. The apparatus of claim 16, wherein the means for releasing includes means for rotating the holding member relative to the stretch wrap packaging material.

23. The apparatus of claim 16, wherein the means for holding includes an unopposed surface for holding a single side of the stretch wrap packaging material with the holding member.

24. The apparatus of claim 16, wherein the means for adhering includes an unopposed surface for holding the stretch wrap packaging material with the holding member.

25. The apparatus of claim 16, wherein the means for adhering includes an unclamped surface for holding the stretch wrap packaging material with the holding member.

26. The apparatus of claim 16, wherein the means for adhering includes a means for holding a single side of the stretch wrap packaging material with the holding member.

27. An apparatus for stretch wrapping a load with a sheet of stretch wrap packaging material in a wrapping area and selectively holding the sheet of stretch wrap packaging material with a holding member at a holding location in the wrapping area comprising:

a holding member;

an actuator for moving the holding member;

a surface between the wrapping area and the actuator;

means for holding a leading end portion of a sheet of stretch wrap packaging material in place against the holding member with a vacuum, and releasing the leading end portion of the stretch wrap packaging material from the holding member by stopping the vacuum, retracting the holding member out of the wrapping area, and moving the holding member relative to the stretch wrap packaging material and the surface between the holding location in the wrapping area and the actuator;

a stretch wrap dispenser for dispensing a sheet of stretch wrap packaging material;

means for providing relative rotation between the dispenser and the load to wrap the stretch wrap packaging material on the load; and means for severing the stretch wrap packaging material between the load and the holding member while holding a trailing end portion of the stretch wrap packaging material with the holding member.

28. The apparatus of claim 27, wherein the holding member includes a slender channel and the means for adhering includes means for applying a vacuum to the slender channel.

29. The apparatus of claim 27, wherein the holding member includes a slender channel divided into a series of apertures and the means for adhering includes means for applying a vacuum to the slender channel and series of apertures.

30. The apparatus of claim 27, wherein the means for releasing includes means for supplying air for blowing the stretch wrap packaging material away from the holding member.

31. The apparatus of claim 27, wherein the means for releasing includes means for supplying air for blowing the stretch wrap packaging material away from the holding member by reversing the vacuum.

32. The method of claim 11, wherein the holding member is a single holding member.

33. The method of claim 11, wherein the holding member is extended into and out of the wrapping area from a single side of the wrapping area.

34. The method of claim 11 wherein the holding member is linearly retracted.

35. The method of claim 11, wherein the holding member is retracted with a single motion and in a single linear direction.

36. The method of claim 11, wherein the holding member slides relative to the stretch wrap packaging material in a single linear direction.

37. The apparatus of claim 27, wherein the holding member is a single holding member.

38. The apparatus of claim 27, wherein the holding member is extended into and retracted out of the wrapping area from a single side of the wrapping area.

39. The apparatus of claim 38, wherein the holding invention is linearly retracted.

40. The apparatus of claim 38, wherein the holding member is retracted with a single motion and in a single linear direction.

41. The apparatus of claim 27, wherein the holding member slides relative to the stretch wrap packaging material in a single linear direction.

42. The apparatus of claim 27, including a turntable and wherein the holding member is mounted on the turntable.

43. The apparatus of claim 27, including a conveyor and wherein the holding member is mounted on the conveyor.

* * * * *

UNITED STATES PATENT AND TRADEMARK OFFICE

CERTIFICATE OF CORRECTION

PATENT NO. : 5,564,258

DATED : October 15, 1996

INVENTOR(S) : Robert D. Janes, Sr., et al.

It is certified that error appears in the above-identified patent and that said Letters Patent is hereby corrected as shown below:

Title Page item [75], after "Inventors:" change "Robert D. Jones, Sr." to -- Robert D. Janes, Sr. --

Title page item [73],

After "Assignee:" change "Lanatech, Inc." to -- Lantech, Inc. --

Claim 1, Col. 5, line 31, change "warp" to -- wrap --

Signed and Sealed this

Tenth Day of December, 1996

*Attest:*

*Attesting Officer*

BRUCE LEHMAN

*Commissioner of Patents and Trademarks*